US012123103B2

(12) United States Patent
Kondoh

(10) Patent No.: US 12,123,103 B2
(45) Date of Patent: Oct. 22, 2024

(54) FILM FORMING APPARATUS FOR FORMING METAL FILM AND FILM FORMING METHOD FOR FORMING METAL FILM

(71) Applicant: TOYOTA JIDOSHA KABUSHIKI KAISHA, Toyota (JP)

(72) Inventor: Haruki Kondoh, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/045,512

(22) Filed: Oct. 11, 2022

(65) Prior Publication Data

US 2023/0122871 A1 Apr. 20, 2023

(30) Foreign Application Priority Data

Oct. 14, 2021 (JP) ..... 2021-168472

(51) Int. Cl.
*C25D 21/12* (2006.01)
*C25D 17/00* (2006.01)

(52) U.S. Cl.
CPC ..... *C25D 21/12* (2013.01); *C25D 17/002* (2013.01)

(58) Field of Classification Search
CPC ..... C25D 17/002
See application file for complete search history.

(56) References Cited

U.S. PATENT DOCUMENTS

| | | | | |
|---|---|---|---|---|
| 4,341,610 | A * | 7/1982 | Schumacher | C25D 7/123 205/139 |
| 6,398,926 | B1 | 6/2002 | Mahneke | |
| 2015/0014178 | A1 | 1/2015 | Hiraoka et al. | |
| 2016/0265126 | A1 | 9/2016 | Hiraoka et al. | |
| 2016/0265129 | A1* | 9/2016 | Hiraoka | C25D 17/00 |

FOREIGN PATENT DOCUMENTS

| | | | |
|---|---|---|---|
| JP | 2005-530926 | A | 10/2005 |
| JP | 5605517 | B2 | 10/2014 |
| JP | 2016169399 | A | 9/2016 |
| WO | 2004/001100 | A1 | 12/2003 |
| WO | 2015072481 | A1 | 5/2015 |

* cited by examiner

*Primary Examiner* — Hosung Chung
(74) *Attorney, Agent, or Firm* — Dickinson Wright, PLLC

(57) ABSTRACT

Provided is a film forming apparatus and a film forming method capable of forming a homogenous metal film by suppressing accumulation of an electrolytic solution between a solid electrolyte membrane and a substrate. A film forming apparatus for forming a metal film includes an anode; a solid electrolyte membrane disposed between the anode and a substrate; a power supply that applies a current between the anode and the substrate; a mount base including a housing recess according to a shape of the substrate that is housed therein; and a housing including a storing chamber that stores an electrolytic solution together with the anode and having the solid electrolyte membrane attached thereto to seal the storing chamber. The mount base includes a liquid discharge portion that discharges the electrolytic solution having passed through the solid electrolyte membrane from a position facing an end face of a side wall of the housing.

2 Claims, 9 Drawing Sheets

FILM FORMING APPARATUS FOR FORMING METAL FILM AND FILM FORMING METHOD FOR FORMING METAL FILM

CROSS REFERENCE TO RELATED APPLICATIONS

The present application claims priority from Japanese patent application JP 2021-168472 filed on Oct. 14, 2021, the entire content of which is hereby incorporated by reference into this application.

BACKGROUND

Technical Field

The present disclosure relates to a film forming apparatus and a film forming method for forming a metal film on a surface of a substrate by depositing metal derived from metal ions on the surface of the substrate.

Background Art

For example, JP 2016-169399 A proposes a film forming apparatus including: an anode; a solid electrolyte membrane that is disposed between the anode and a substrate that serves as a cathode; a power supply that applies a current between the anode and the substrate; and a mount base on which the substrate is placed. A housing recess for housing the substrate is formed on the mount base of the film forming apparatus, and a bottom surface of the housing recess is provided with a suction portion for sucking the solid electrolyte membrane such that the solid electrolyte membrane is brought into intimate contact with the surface of the substrate.

This suction portion includes suction ports formed on the bottom surface of the housing recess and is configured to suck the solid electrolyte membrane through the suction ports so as to pressurize the surface of the substrate with the solid electrolyte membrane. By applying a current between the anode and the substrate in the pressurizing state, the film forming apparatus forms a metal film on the surface of the substrate.

SUMMARY

By the way, when a film is formed using a solid electrolyte membrane, an electrolytic solution may pass through the solid electrolyte membrane toward the substrate together with metal ions passing through the solid electrolyte membrane. Since the solid electrolyte membrane is pressed against the substrate during film formation, it is assumed that the electrolytic solution having passed toward the substrate will accumulate between the solid electrolyte membrane and the substrate. Such accumulation of the electrolytic solution may make it difficult to deposit metal derived from metal ions on the surface of the substrate, and a homogenous metal film may not be formed.

When the film forming apparatus disclosed in JP 2016-169399 A is used, for example, it is assumed that the accumulated electrolytic solution will be discharged from a clearance between the side wall surface of the housing recess that houses the substrate and the side surface of the substrate. However, since the clearance from which the electrolytic solution is discharged is facing the electrolytic solution via the solid electrolyte membrane, the solid electrolyte membrane facing this clearance tends to deform, and when the electrolytic solution is discharged during film formation, the solid electrolyte membrane may deform and enter the clearance with the liquid flow of the electrolytic solution. As a result, it is difficult to sufficiently discharge the electrolytic solution accumulated between the solid electrolyte membrane and the substrate during film formation, and the solid electrolyte membrane may be damaged as well.

In view of the foregoing, the present disclosure provides a film forming apparatus and a film forming method capable of forming a homogenous metal film by suppressing accumulation of an electrolytic solution between a solid electrolyte membrane and a substrate.

In view of the foregoing, a film forming apparatus for forming a metal film according to the present disclosure includes: an anode; a solid electrolyte membrane disposed between the anode and a substrate that serves as a cathode; a power supply configured to apply a current between the anode and the substrate; a mount base on which the substrate is placed; and a housing including a storing chamber that stores an electrolytic solution together with the anode and having the solid electrolyte membrane attached thereto so as to seal the storing chamber, in which the current is applied in a state where the solid electrolyte membrane is pressed against the substrate with a fluid pressure of the electrolytic solution in the storing chamber to form a metal film from metal ions contained in the electrolytic solution on a surface of the substrate, and the mount base includes a liquid discharge portion configured to discharge the electrolytic solution having passed through the solid electrolyte membrane from a position facing an end face of a side wall of the housing.

According to the present disclosure, it is possible to deposit metal on the surface of the substrate by applying a voltage across the anode and the substrate in a state where the solid electrolyte membrane is pressed against the surface of the substrate with a fluid pressure of the electrolytic solution in the storing chamber and allowing metal ions contained in the electrolytic solution stored in the storing chamber to pass through the solid electrolyte membrane. Accordingly, a metal film can be formed on the surface of the substrate.

Here, according to the present disclosure, the mount base includes a liquid discharge portion configured to discharge the electrolytic solution having passed through the solid electrolyte membrane from a position facing an end face of a side wall of the housing. Therefore, the electrolytic solution stored in the storing chamber does not exist in a portion opposite to the liquid discharge portion via the solid electrolyte membrane, and thus the electrolytic solution will not be discharged from the position facing the portion where the solid electrolyte membrane tends to deform. Consequently, the solid electrolyte membrane will not deform to block the liquid discharge portion with the fluid pressure of the electrolytic solution, the liquid flow of the electrolytic solution, or the like, and thus, while avoiding damage of the solid electrolyte membrane, it is possible to easily discharge the electrolytic solution having passed through the solid electrolyte membrane via the liquid discharge portion. In this manner, according to the present disclosure, it is possible to discharge the electrolytic solution accumulating between the solid electrolyte membrane and the substrate and also form a homogenous metal film.

Here, the liquid discharge portion may include a plurality of liquid discharge ports. However, in some embodiments, the mount base includes a housing recess that is formed in accordance with a shape of the substrate as a recess for placement, the liquid discharge portion includes a liquid discharge groove, and the liquid discharge groove is formed to surround the housing recess with a distance from an edge of the housing recess.

According to this embodiment, since the liquid discharge groove is provided around the substrate housed in the housing recess, during formation of a metal film, it is possible to more uniformly discharge, from around the substrate, the electrolytic solution flowing out from between the solid electrolyte membrane and the substrate.

In addition, the electrolytic solution need not be sucked as long as the solid electrolyte membrane, with a fluid pressure of the electrolytic solution, can press and flow the electrolytic solution toward the liquid discharge portion from between the solid electrolyte membrane and the substrate. However, in some embodiments, a suction pump that sucks the electrolytic solution from the liquid discharge portion is coupled to the liquid discharge portion.

According to this embodiment, with a negative pressure generated by the suction pump within the liquid discharge portion, the electrolytic solution can be efficiently sucked out from between the solid electrolyte membrane and the substrate and discharged to the outside of the film forming apparatus via the liquid discharge portion.

Here, when a suction pump is provided, the suction pump may be continuously operated from a timing when film formation is started to a timing when film formation ends. However, in some embodiments, the power supply is configured to apply a current between the anode and the substrate such that a current applied between the anode and the substrate is kept constant during formation of the metal film. The film forming apparatus further includes: a voltmeter configured to measure a voltage across the anode and the substrate; and a control device configured to control starting and stopping of the suction pump, in which during the formation of the metal film, the control device starts the suction pump when a voltage measured by the voltmeter is equal to or higher than a predetermined voltage value, and stops the suction pump after a lapse of a time set in advance after the suction pump is started.

When the electrolytic solution having passed through the solid electrolyte membrane is remaining between the solid electrolyte membrane and the substrate during film formation, since metal ions contained in this electrolytic solution are being used in the film formation, a voltage across the anode and the substrate increases. Therefore, during formation of the metal film, when a voltage across the anode and the substrate is equal to or higher than a predetermined voltage value, it can be judged that the electrolytic solution in a sufficient amount has accumulated between the solid electrolyte membrane and the substrate. Then, according to this embodiment, the control device can start the suction pump at such a timing and, while sucking the accumulated electrolytic solution, forcibly discharge the sucked electrolytic solution until a time set in advance passes after the suction pump is started. In this manner, effectively starting and stopping the suction pump allows the suction pump to efficiently suck out the electrolytic solution accumulated between the solid electrolyte membrane and the substrate, and a homogenous metal film can be formed.

A film forming method for forming a metal film according to the present disclosure is a film forming method for forming a metal film from metal ions contained in an electrolytic solution on a surface of a substrate by applying a current between an anode and the substrate that serves as a cathode in a state where a solid electrolyte membrane is pressed against the substrate with a fluid pressure of the electrolytic solution stored in a storing chamber, the film forming method including: placing the substrate on a mount base; bringing the solid electrolyte membrane into contact with the substrate placed on the mount base and pressing the solid electrolyte membrane against the substrate with the fluid pressure; and in a state where the solid electrolyte membrane is pressed against the substrate, applying a current between the anode and the substrate to form the metal film on the substrate, in which in the forming the metal film, the electrolytic solution having passed through the solid electrolyte membrane is discharged from the surface of the mount base at a position facing an end face of a side wall of a housing including the storing chamber.

According to the present disclosure, in the forming the metal film, a voltage is applied across the anode and the substrate in a state where the solid electrolyte membrane is pressed against the substrate with a fluid pressure of the electrolytic solution in the storing chamber. Accordingly, it is possible to deposit metal on the surface of the substrate by allowing metal ions contained in the electrolytic solution stored in the storing chamber to pass through the solid electrolyte membrane. Consequently, a metal film can be formed on the surface of the substrate.

In addition, according to the present disclosure, in the forming the metal film, the electrolytic solution having passed through the solid electrolyte membrane is discharged from the surface of the mount base at a position facing an end face of a side wall of a housing. Therefore, the electrolytic solution stored in the storing chamber does not exist in a portion opposite to a position where the electrolytic solution is discharged via the solid electrolyte membrane. Consequently, the solid electrolyte membrane will not deform to block the portion from which liquid is discharged, and thus, while avoiding damage of the solid electrolyte membrane, it is possible to easily discharge the electrolytic solution having passed through the solid electrolyte membrane. In this manner, according to the present disclosure, it is possible to discharge the electrolytic solution accumulating between the solid electrolyte membrane and the substrate and also form a homogenous metal film.

Here, a plurality of liquid discharge ports may be provided around the housing recess to discharge the electrolytic solution through the liquid discharge ports. However, in some embodiments, the mount base includes a housing recess that is formed in accordance with a shape of the substrate and a liquid discharge groove that is formed to surround the housing recess with a distance from an edge of the housing recess, in the placing the substrate on the mount base, the substrate is placed on the mount base such that the substrate is housed in the housing recess, and in the forming the metal film, discharge of the electrolytic solution is performed through the liquid discharge groove.

According to this embodiment, since the liquid discharge groove is provided around the substrate housed in the housing recess, during formation of a metal film, it is possible to more uniformly discharge, from around the substrate, the electrolytic solution flowing out from between the solid electrolyte membrane and the substrate.

In addition, the electrolytic solution need not be sucked as long as the solid electrolyte membrane, with a fluid pressure of the electrolytic solution, can press and flow the electrolytic solution from between the solid electrolyte membrane and the substrate so as to discharge the electrolytic solution. However, in some embodiments, in the forming the metal film, the discharge of the electrolytic solution is performed while sucking the electrolytic solution by a suction pump.

According to this embodiment, with a negative pressure generated by the suction pump, the electrolytic solution can be efficiently sucked out from between the solid electrolyte membrane and the substrate and discharged to the outside of the film forming apparatus from a position facing an end face of a side wall of a housing.

Here, when a suction pump is provided, the suction pump may be continuously operated from a timing when film formation is started to a timing when film formation ends. However, in some embodiments, in the forming the metal film, a voltage across the anode and the substrate is measured while the current is kept constant, when a measured voltage is equal to or higher than a predetermined voltage value, suction of the electrolytic solution by the suction pump is started, and after a lapse of a time set in advance after start of the suction, the suction by the suction pump is stopped.

According to this embodiment, when a voltage across the anode and the substrate is equal to or higher than a predetermined voltage value, it can be judged that the electrolytic solution in a sufficient amount has accumulated between the solid electrolyte membrane and the substrate. Therefore, it is possible to start the suction pump at such a timing and, while sucking the accumulated electrolytic solution, forcibly discharge the sucked electrolytic solution until a time set in advance passes after the suction pump is started. In this manner, effectively starting and stopping the suction pump allows the suction pump to efficiently suck out the electrolytic solution accumulated between the solid electrolyte membrane and the substrate, and a homogenous metal film can be formed.

According to the film forming apparatus and the film forming method of the present disclosure, it is possible to form a homogenous metal film by suppressing accumulation of the electrolytic solution between the solid electrolyte membrane and the substrate.

DETAILED DESCRIPTION

Hereinafter, one embodiment and its modification according to the present disclosure will be described with reference to FIG. 1 to FIG. 9.

1. Regarding Structure of Film Forming Apparatus 1

A film forming apparatus 1 for forming a metal film according to the present embodiment will be described with reference to FIG. 1 and FIG. 2. The film forming apparatus 1 of the present embodiment is a film forming apparatus (plating apparatus) for forming a metal film by solid electrolyte deposition using a solid electrolyte membrane. The film forming apparatus 1 is used when forming a metal film F on the surface of a substrate W that serves as a cathode. The film forming apparatus 1 may also be used when continuously forming a metal film F on the surfaces of a plurality of substrates W. The substrate W that serves as a cathode may be a substrate made of a metal material such as copper, nickel, silver, gold, or the like, or may be a substrate including a metal base layer of copper, nickel, silver, gold, or the like formed on a surface of resin, ceramic, or the like. When forming a metal film, this metal base layer is conductive to a negative electrode of a power supply 13 (described later), and serves as a cathode.

Figure 1:
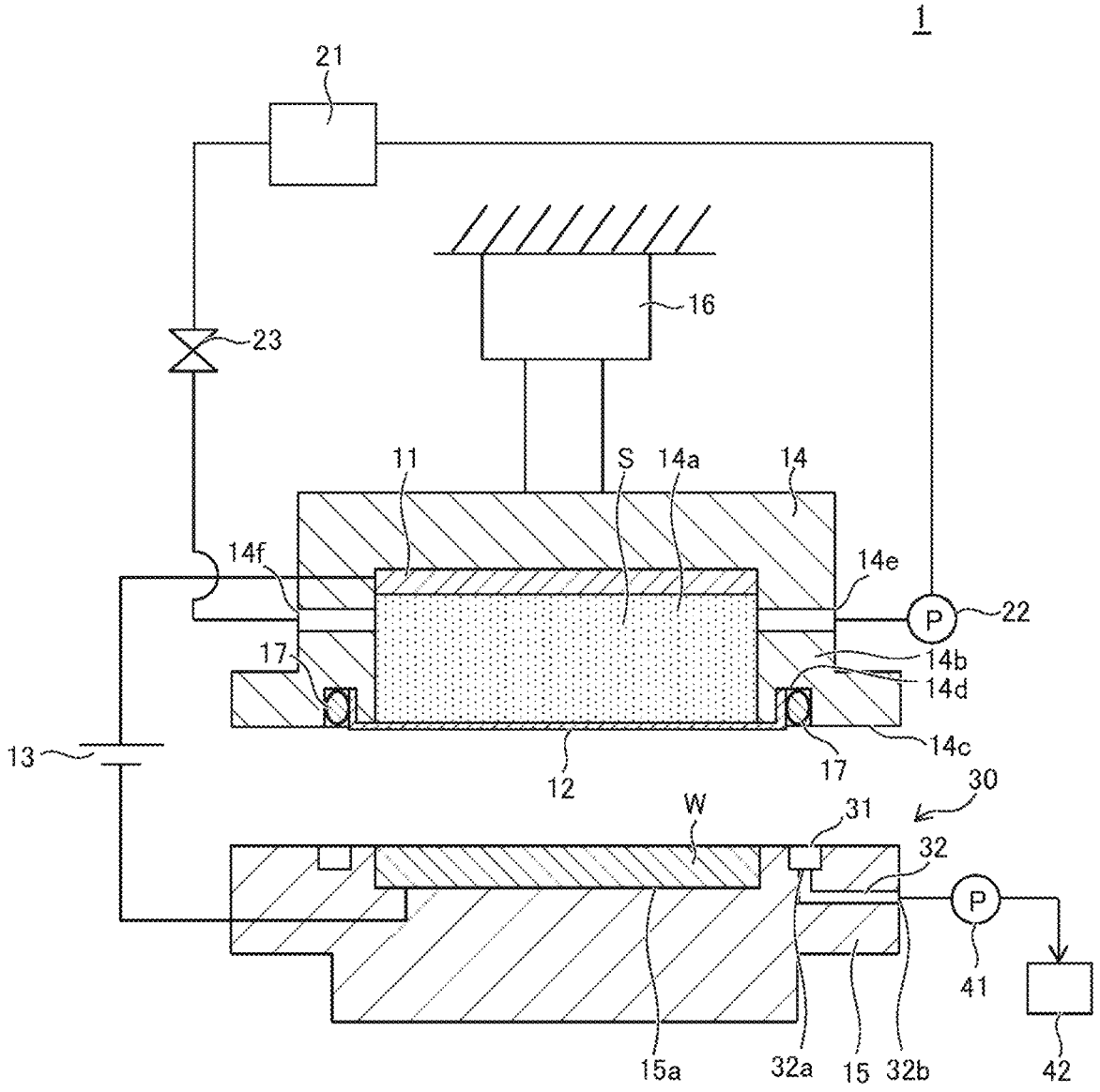
FIG. 1 is a schematic cross-sectional view of a film forming apparatus for forming a metal film according to one embodiment of the present disclosure, illustrating a state where a substrate is placed thereon.

As shown in FIG. 1, the film forming apparatus 1 includes an anode 11, a solid electrolyte membrane 12 that is disposed between the anode 11 and the substrate W, and a power supply (power supply unit) 13 that applies a current between the anode 11 and the substrate W. The film forming apparatus 1 further includes a housing 14 including a storing chamber 14*a* that stores an electrolytic solution S, and a mount base 15 on which the substrate W is placed. The power supply 13 is DC power supply or AC power supply.

In the present embodiment, the anode 11 is electrically coupled to a positive electrode of the power supply 13 and the mount base 15 is electrically coupled to a negative electrode of the power supply 13. As described later, since the mount base 15 is made of a conductive material, the substrate W is conductive to the negative electrode of the power supply 13. Accordingly, the film forming apparatus 1 can apply a current between the anode 11 and the substrate W with the power supply 13 in a state where the solid electrolyte membrane 12 is in contact with the surface of the substrate W.

In the present embodiment, the anode 11 is a plate-like metal anode, for example, and may be either a soluble anode made of the same material (e.g., Cu) as the metal film F, or an anode made of a material (e.g., Ti) that is insoluble in the electrolytic solution S.

The solid electrolyte membrane 12 is not particularly limited as long as it can be impregnated with metal ions (i.e., can contain metal ions therein) when brought into contact with the electrolytic solution S and metal derived from metal ions can be deposited on the surface of the cathode (substrate W) when the anode 11 and the cathode are energized.

The thickness of the solid electrolyte membrane 12 is set such that the solid electrolyte membrane 12 has flexibility with a fluid pressure of the electrolytic solution S, which will be described later. The thickness of the solid electrolyte membrane 12 may be in the range of 1 μm to 200 μm, for example. Examples of the material of the solid electrolyte membrane 12 may include a fluorine-based resin, such as Nafion (registered trademark) available from DuPont, a hydrocarbon-based resin, a polyamic resin, or a resin having cation exchange functionality, such as Selemion (CMV, CMD, CMF series) available from AGC Inc.

The electrolytic solution S is a solution containing metal in a state of ions of the metal film F. The metal may be Cu, Ni, Zn, Ag, Sn, Au, or the like, for example. The electrolytic solution S may be a solution containing such metal dissolved (ionized) in an acid, such as nitric acid, phosphoric acid, succinic acid, sulfuric acid, pyrophosphoric acid, or the like.

In the present embodiment, the housing 14 is made of a material that is insoluble in the electrolytic solution S. The housing 14 includes the storing chamber 14*a* that stores the electrolytic solution S together with the anode 11. The solid electrolyte membrane 12 is attached to the housing 14 so as to seal the storing chamber 14*a* that is open downward. Specifically, the anode 11 is disposed in the storing chamber 14*a* such that the anode 11 and the solid electrolyte membrane 12 are spaced apart from each other, and the electrolytic solution S is stored between the anode 11 and the solid electrolyte membrane 12 so as to be in contact with them.

In the present embodiment, the housing 14 includes, on an a end face 14*c* of a side wall 14*b*, an insertion groove 14*d* into which a sealing member 17 is inserted in a state where the edge of the solid electrolyte membrane 12 is bent. The insertion groove 14*d* is formed around the opening of the storing chamber 14*a*. The sealing member 17 is inserted into the insertion groove 14*d* in a state where the edge of the solid electrolyte membrane 12 is bent, and the elastically deformed sealing member 17 is pressed against the edge of the solid electrolyte membrane 12 such that the solid electrolyte membrane 12 can seal the storing chamber 14*a* that is open downward.

The housing 14 includes a supply port 14*e* through which the electrolytic solution S is supplied and a discharge port 14*f* through which the electrolytic solution S is discharged. The supply port 14*e* and the discharge port 14*f* are coupled to a tank 21 via a pipe. A pressure pump 22 for pressure-feeding the electrolytic solution S in the tank 21 is provided between the tank 21 and the supply port 14*e*. Accordingly, the electrolytic solution S fed by the pressure pump 22 from the tank 21 is introduced into the storing chamber 14*a* through the supply port 14*e*, and the introduced electrolytic solution S is discharged through the discharge port 14*f* such that the discharged electrolytic solution S can return to the tank 21.

In addition, in the present embodiment, a pressure regulating valve 23 is provided downstream of the discharge port 14*f*. The pressure regulating valve 23 and the pressure pump 22 can pressurize the electrolytic solution S in the storing chamber 14*a* at a predetermined pressure. In this manner, the solid electrolyte membrane 12 can be pressed against the substrate W that is in contact with the solid electrolyte membrane 12 with a fluid pressure of the electrolytic solution S during film formation (see FIG. 4). Accordingly, it is possible to form a metal film F on the substrate W while uniformly pressurizing the substrate W with the solid electrolyte membrane 12. It should be noted that in this specification, the pressure regulating valve 23 and the pressure pump 22 are referred to as a pressing mechanism.

The mount base 15 includes a housing recess 15*a* that is formed in accordance with the shape of the substrate W. The housing recess 15*a* is a placement recess for placing the substrate W, and the substrate W is housed in the housing recess 15*a*, whereby the substrate W is placed. In the present embodiment, in one example, in a state where the substrate W is housed in the housing recess 15*a*, there may be no clearance between the side wall surface of the housing recess 15*a* and the side surface of the substrate W, and specifically, the surface of the mount base 15 and the surface of the substrate W may be formed on the same plane.

With this configuration, the electrolytic solution S having passed through the solid electrolyte membrane 12 is likely to flow from between the solid electrolyte membrane 12 and the substrate W toward a liquid discharge portion 30, which will be described later. However, even if there is a clearance between the side wall surface of the housing recess 15*a* and the side surface of the substrate W, once the clearance is filled with the electrolytic solution S having passed through the solid electrolyte membrane 12, the more electrolytic solution S having passed through the solid electrolyte membrane 12 is likely to flow toward the liquid discharge portion 30. Therefore, as will be described later, the electrolytic solution S is less likely to accumulate between the solid electrolyte membrane 12 and the substrate W. It should be noted that as long as the electrolytic solution S accumulating between the solid electrolyte membrane 12 and the metal film F can be discharged, the mount base 15 need not include the housing recess 15*a*.

In the present embodiment, the film forming apparatus 1 further includes an elevating device 16 coupled to the upper part of the housing 14. The elevating device 16 is configured to move the housing 14 upward and downward between a position where the solid electrolyte membrane 12 is spaced apart from the substrate W and a position where the solid electrolyte membrane 12 comes into contact with the substrate W. Details of the elevating device 16 are not limited as long as the elevating device 16 can move the housing 14 upward and downward, and the elevating device 16 may be configured by a hydraulic or pneumatic cylinder, a motor-driven actuator, a linear guide and a motor, for example.

By the way, during formation of a metal film F, metal ions with coordinated water molecules move within the solid electrolyte membrane 12, and the metal ions moved to the side of the substrate W are reduced (receive electrons) on the surface of the substrate W, and thus metal is deposited. Since the movement of the metal ions during formation of a metal film F allows the electrolytic solution S to pass through the solid electrolyte membrane 12, and the metal ions contained in the electrolytic solution S having passed through the solid electrolyte membrane 12 are used in the film formation, a solvent contained in the electrolytic solution S may accumulate between the substrate W and the solid electrolyte membrane 12. As used herein, "the electrolytic solution having passed through the solid electrolyte membrane" of the present disclosure strictly means a liquid that is derived from the electrolytic solution passing through the solid electrolyte membrane along with the movement of the metal ions and has a composition slightly different from that of a liquid included in the storing chamber 14*a*.

Figure 9:
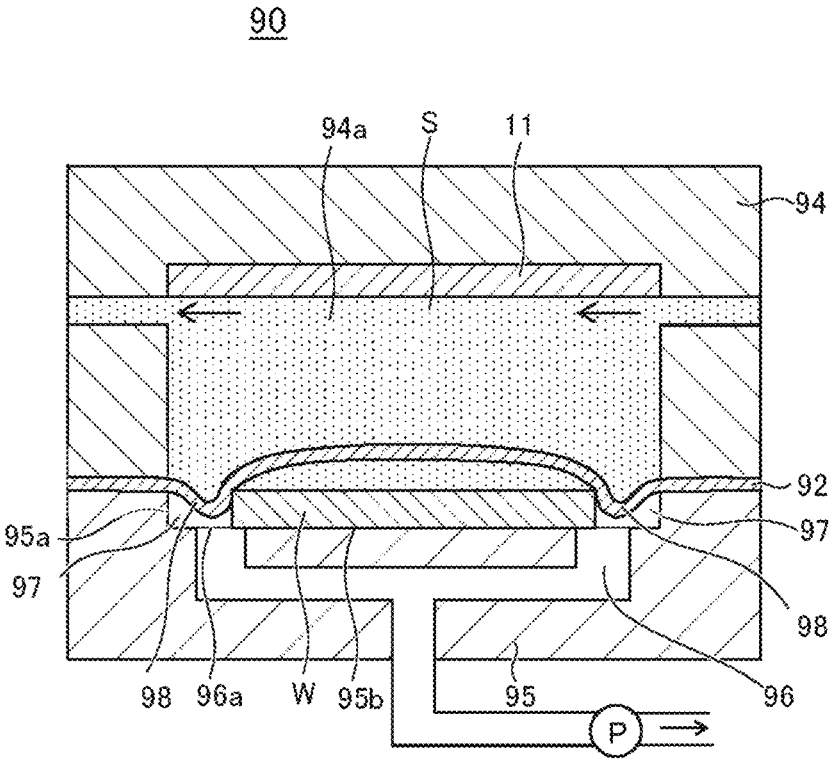
FIG. 9 is a schematic cross-sectional view of a film forming apparatus to be compared, illustrating a state where a solid electrolyte membrane has a bent portion in which the solid electrolyte membrane is deformed to be separated from a substrate.

Consequently, in a film forming apparatus 90 to be compared as shown in FIG. 9, an electrolytic solution S stored in a storing chamber 94*a* of a housing 94 passes through a solid electrolyte membrane 92 when the anode 11 and the substrate W are energized. The electrolytic solution S having passed through the solid electrolyte membrane 92 accumulates between the solid electrolyte membrane 92 and the substrate W. Since the metal ions contained in the accumulated electrolytic solution S are used and the accumulated electrolytic solution S thus contains a component of a solvent in an excessive amount, the electrolytic solution S may act as electric resistance during film formation. When the amount of the accumulated electrolytic solution S increases, the solid electrolyte membrane 92 may deform so as to be separated from the substrate W due to the accumulated electrolytic solution, resulting in a large clearance between the solid electrolyte membrane 92 and the surface of the substrate W during film formation. This may make it difficult to deposit metal derived from metal ions on the surface of the substrate W, and a homogenous metal film may not be formed.

Here, in the film forming apparatus 90 shown in FIG. 9, a mount base 95 on which the substrate W is placed includes a housing recess 95*a* that houses the substrate W, and the film forming apparatus 90 is configured to discharge liquid with a liquid discharge portion 96 that includes a clearance 97 between the side surface of the substrate W and the side wall surface of the housing recess 95*a*. However, when a liquid flow for discharging the electrolytic solution S is generated in the liquid discharge portion 96 including the clearance 97, the solid electrolyte membrane 92 may enter this clearance 97 and form a bent portion 98 in which the solid electrolyte membrane 92 is bent. This may inhibit the ability to discharge the electrolytic solution S accumulated between the solid electrolyte membrane 92 and the substrate W, and damage the bent portion 98 of the solid electrolyte membrane 92.

In view of this, in the present embodiment, the mount base 15 includes the liquid discharge portion 30 configured to discharge the electrolytic solution S having passed through the solid electrolyte membrane 12. The liquid discharge portion 30 discharges the electrolytic solution S having passed through the solid electrolyte membrane 12 from the position facing the end face 14*c* of the side wall 14*b* of the housing 14 including the storing chamber 14*a*. That is, the liquid discharge portion 30 discharges the electrolytic solution S having passed through the solid electrolyte membrane 12 from a position displaced from the storing chamber 14*a*.

Figure 2:
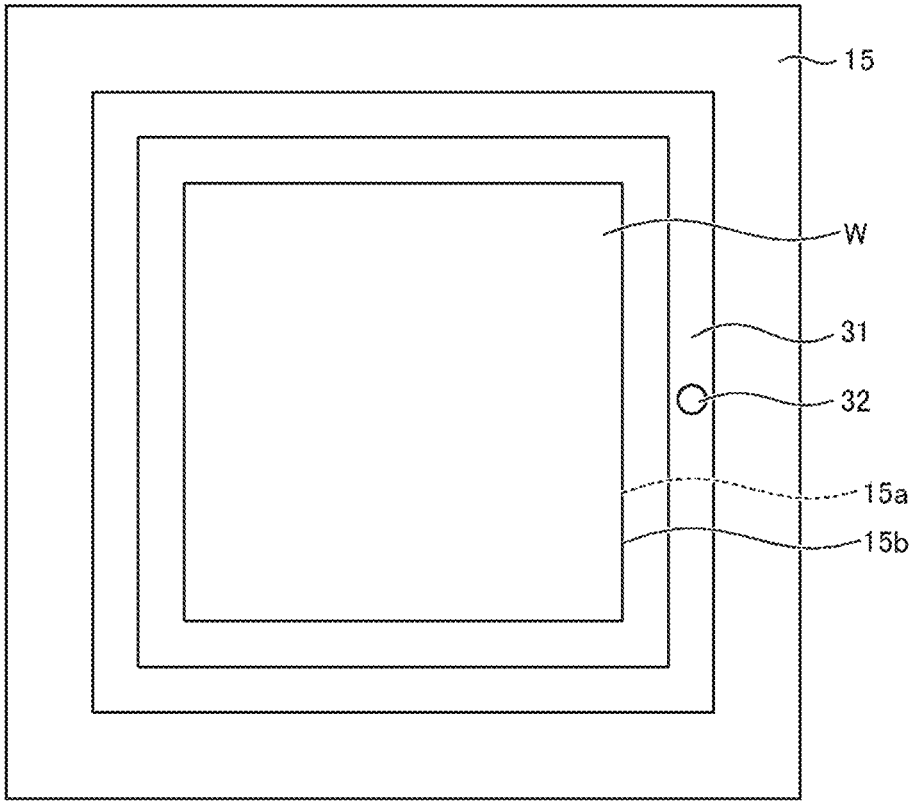
FIG. 2 illustrates a mount base of the film forming apparatus shown in FIG. 1 as seen from a housing side.

In the present embodiment, as shown in FIG. 1 and FIG. 2, the liquid discharge portion 30 includes a liquid discharge groove 31 and a liquid discharge passage 32 communicated with the liquid discharge groove 31. The liquid discharge groove 31 is formed on the surface of the mount base 15 at a position away from the housing recess 15*a* (specifically, at a position facing the end face 14*c* of the side wall 14*b* of the housing 14).

In the present embodiment, as shown in FIG. 2, the liquid discharge groove 31 is formed to surround the housing recess 15*a* with a distance from an edge 15*b* of the housing recess 15*a*. The liquid discharge groove 31 is communicated with the liquid discharge passage 32 via a coupling portion 32*a*. The liquid discharge groove 31 may be inclined such that the electrolytic solution S flows toward the coupling portion 32*a* of the liquid discharge passage 32. In the present embodiment, the liquid discharge passage 32 is formed inside of the mount base 15. In the present embodiment, one coupling portion 32*a* is provided, but a plurality of coupling portions that couples the liquid discharge groove 31 and the liquid discharge passage 32 may be provided such that the electrolytic solution S flowing in the liquid discharge groove 31 is discharged from the plurality of coupling portions.

It should be noted that in the present embodiment, although the liquid discharge groove 31 is formed at a position facing the sealing member 17 as shown in FIG. 1, the position of the liquid discharge groove 31 is not particularly limited thereto as long as the electrolytic solution S can be discharged at a position displaced from the storing chamber 14*a* and the housing recess 15*a*. Specifically, the liquid discharge groove 31 may be provided outward of the sealing member 17, at a position facing the end face 14*c* of the housing 14 where the side wall 14*b* is exposed, or may be provided inward of the sealing member 17, at a position facing the solid electrolyte membrane 12 that covers the end face 14*c* of the side wall 14*b*. In addition, the liquid discharge portion 30 may include a plurality of liquid discharge ports instead of the liquid discharge groove 31 as long as the electrolytic solution S can be discharged. The liquid discharge groove 31 may be formed along at least a portion of the edge 15*b* of the housing recess 15*a* as long as the electrolytic solution S having passed through the solid electrolyte membrane 12 can be discharged.

An end portion 32*b* of the liquid discharge portion 30 (liquid discharge passage 32) may be provided with a tank for collecting liquid to be discharged or the like as long as the electrolytic solution S can be discharged from the end portion 32*b* without suction or the like. In the present embodiment, however, a suction pump 41 that sucks the electrolytic solution S having passed through the solid electrolyte membrane 12 from the liquid discharge portion 30 is coupled to the liquid discharge portion 30. A collection tank 42 for collecting the electrolytic solution S is provided downstream of the suction pump 41.

2. Regarding Film Forming Method for Forming Metal Film F

Figure 3:
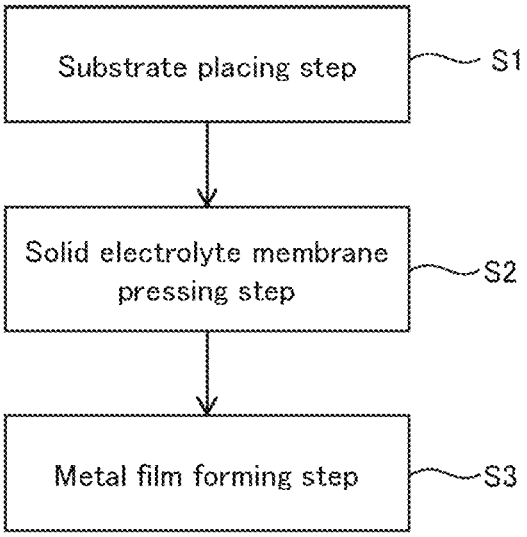
FIG. 3 is a flowchart of the steps of a film forming method for forming a metal film using the film forming apparatus shown in FIG. 1.

A film forming method for forming a metal film F according to the present embodiment will be described with reference to FIG. 3 and FIG. 4, together with operations and effects of the film forming apparatus 1. It should be noted that the film forming method will be described with reference to the flow of the steps shown in FIG. 3.

2-1. Regarding Substrate W Placing Step S1

The film forming method for forming a metal film F according to the present embodiment first performs a substrate W placing step S1. In this step, the substrate W is placed on the mount base 15 (see FIG. 1). Specifically, in a state where the housing 14 is disposed above the mount base 15, the substrate W is placed on the mount base 15 such that the substrate W is housed in the housing recess 15*a* of the mount base 15. Accordingly, the substrate W is placed in a position opposite to the storing chamber 14*a* via the solid electrolyte membrane 12.

2-2. Regarding Solid Electrolyte Membrane 12 Pressing Step S2

Next, the film forming method performs a solid electrolyte membrane 12 pressing step S2. In this step, as shown in FIG. 4, the solid electrolyte membrane 12 attached to the housing 14 is brought into contact with the substrate W placed on the mount base 15 and pressed against the substrate W with a fluid pressure.

Figure 4:
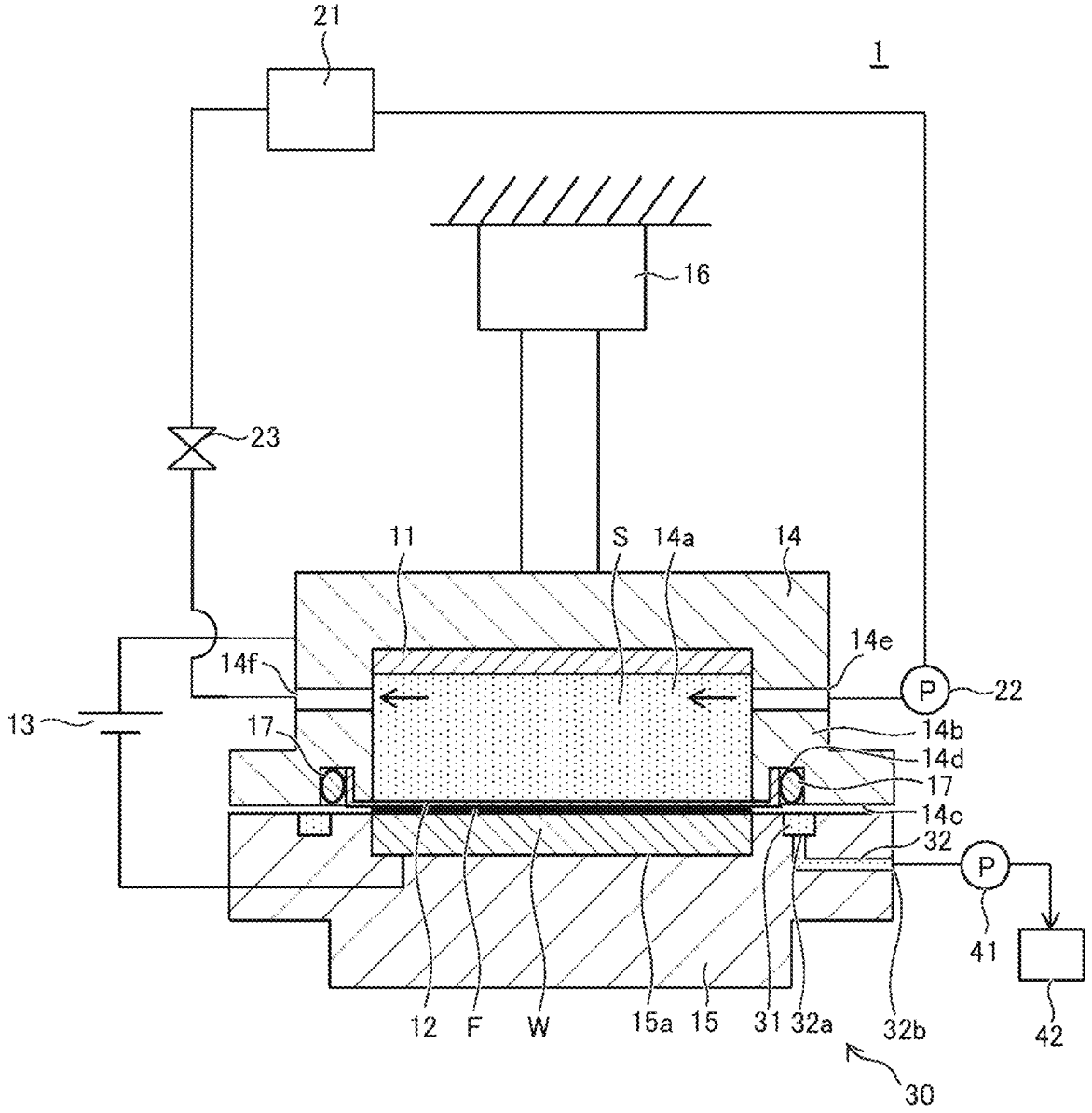
FIG. 4 is a schematic conceptual view illustrating a film forming step of forming a metal film shown in FIG. 3.

Specifically, the elevating device 16 moves the housing 14 toward the substrate W and brings the solid electrolyte membrane 12, which is attached to the housing 14 so as to face the substrate W, into contact with the surface of the substrate W (see FIG. 1 and FIG. 4). While the solid electrolyte membrane 12 and the substrate W are in contact with each other, the pressing mechanism (i.e., the pressure pump 22 and the pressure regulating valve 23) presses the solid electrolyte membrane 12 against the substrate W under the pressure conditions for forming a metal film F. Consequently, the pressure of the electrolytic solution S is increased by the pressure pump 22 such that the solid electrolyte membrane 12 is allowed to follow the surface of the substrate W, and the pressure of the electrolytic solution S within the housing 14 becomes a constant pressure set by the pressure regulating valve 23. Accordingly, the solid electrolyte membrane 12 can uniformly press the surface of the substrate W with the regulated fluid pressure of the electrolytic solution S within the housing 14.

2-3. Regarding Metal Film Forming Step S3

Next, the film forming method performs a metal film forming step S3. In this step, as shown in FIG. 4, while the solid electrolyte membrane 12 is pressed, the power supply 13 applies a current between the anode 11 and the substrate W such that a metal film F is formed on the substrate W. Here, during film formation, the electrolytic solution S having passed through the solid electrolyte membrane 12 is discharged from the surface of the mount base 15 at a position facing the end face 14*c* of the side wall 14*b* of the housing 14 including the storing chamber 14*a*. More specifically, the discharge of the electrolytic solution S is performed by the liquid discharge portion 30.

According to the present embodiment, with such a configuration, during formation of a metal film F, the electrolytic solution S stored in the storing chamber 14*a* does not exist in a portion opposite to the liquid discharge portion 30 via the solid electrolyte membrane 12. That is, the electrolytic solution S will not be discharged from a position facing the portion where the solid electrolyte membrane 12 tends to deform (i.e., the portion facing the storing chamber 14*a*).

Consequently, it is possible to reduce the likelihood that the solid electrolyte membrane 12 will deform to block the liquid discharge portion 30 with the fluid pressure of the electrolytic solution S or the liquid flow of the electrolytic solution S, and thus, while avoiding damage of the solid electrolyte membrane 12, it is possible to easily discharge the electrolytic solution S having passed through the solid electrolyte membrane 12 via the liquid discharge portion 30.

In particular, since the liquid discharge groove 31 is provided around the substrate W housed in the housing recess 15*a* as a portion of the liquid discharge portion 30, during formation of a metal film F, it is possible to more uniformly discharge, from around the substrate W, the electrolytic solution S flowing out from between the solid electrolyte membrane 12 and the substrate W. Accordingly, it is possible to reduce the likelihood that the solid electrolyte membrane 12 will deform so as to be separated from the substrate W as shown in FIG. 9.

Furthermore, with a negative pressure generated by the suction pump 41 within the liquid discharge portion 30, the electrolytic solution S can be efficiently sucked out from between the solid electrolyte membrane 12 and the substrate W and discharged to the outside of the mount base 15 via the liquid discharge portion 30.

As described above, it is possible to discharge the electrolytic solution S accumulating between the solid electrolyte membrane 12 and the substrate W and also form a homogenous metal film F on the surface of the substrate W.

<Modification>

A film forming apparatus 1 for forming a metal film F and a film forming method for forming a metal film F according to a modification of the present embodiment will be described with reference to FIG. 5 and FIG. 6. In this modification, the suction pump 41 forcibly performs liquid discharge via the liquid discharge portion 30 based on a voltage value across the anode 11 and the substrate W during film formation. The modification is different from the foregoing embodiment in this respect. The following mainly describes such a difference from the foregoing embodiment.

Figure 5:
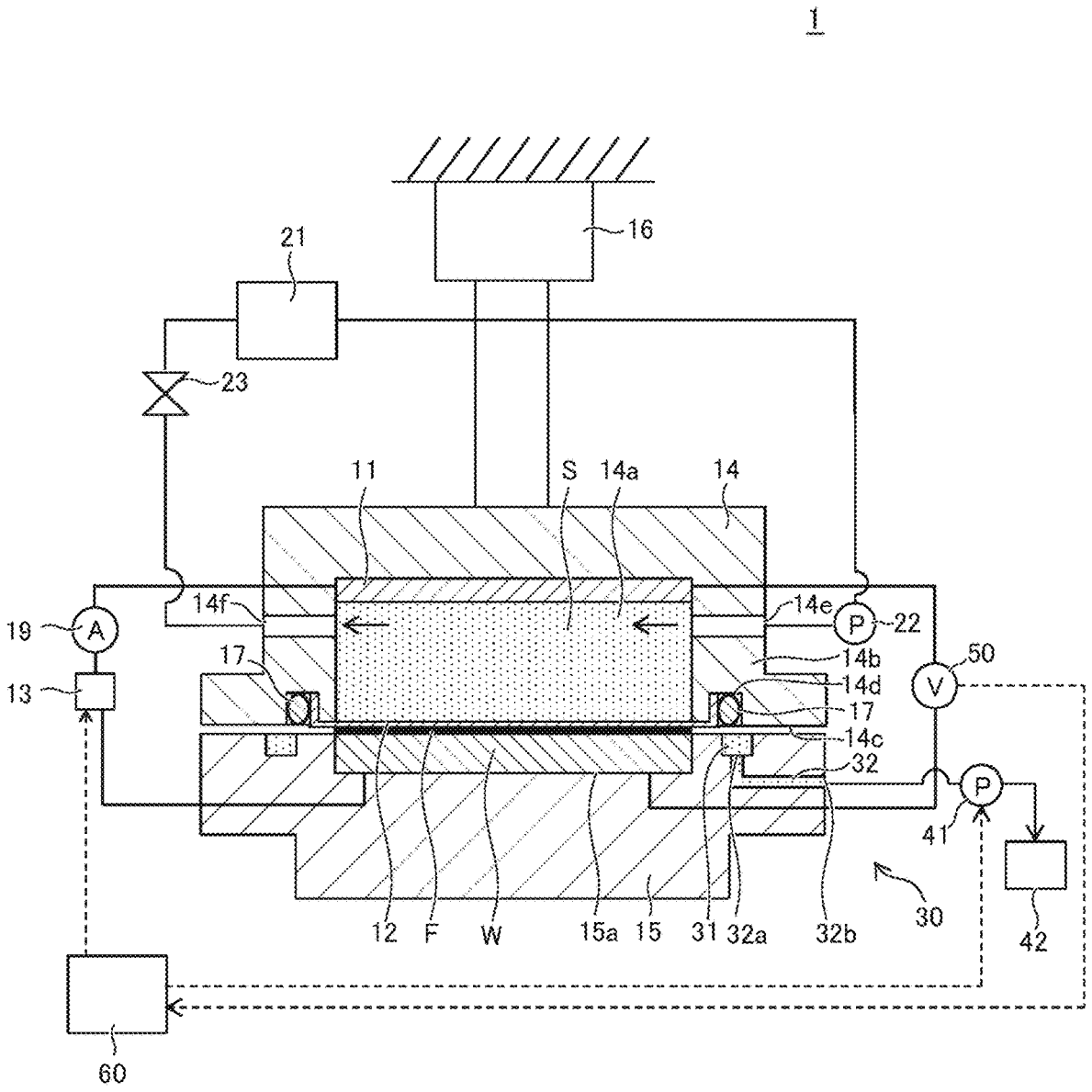
FIG. 5 is a schematic cross-sectional view illustrating a modification of the film forming apparatus shown in FIG. 1.

As shown in FIG. 5, in the film forming apparatus 1 of the modification, the suction pump 41 is coupled to the liquid discharge portion 30 of the foregoing embodiment. In addition, in this modification, the power supply 13 applies a current between the anode 11 and the substrate W such that a current applied between the solid electrolyte membrane 12 and the substrate W is kept constant. To achieve such current control, the power supply 13 may include a control circuit for controlling a voltage applied such that a current measured by an ammeter 19 is kept constant.

The film forming apparatus 1 can keep a constant film formation speed of a metal film F with the power supply 13 that controls a current applied between the anode 11 and the substrate W to be constant. Accordingly, by setting in advance a time from start to end of current application, the film forming apparatus 1 can form a metal film F into a desired thickness.

In this modification, the film forming apparatus 1 further includes a voltmeter 50 and a control device 60. The voltmeter 50 is configured to measure a voltage across the anode 11 and the substrate W. The voltmeter 50 is electrically coupled to the control device 60 such that a value (voltage value) measured by the voltmeter 50 is input to the control device 60 as a signal.

Here, the control device 60 basically includes, as hardware, an operation unit, such as a CPU or the like, a storage unit, such as RAM, ROM, or the like. The operation unit determines whether a voltage value is equal to or higher than a predetermined voltage value based on a signal of the voltmeter 50, calculates control signals to the power supply 13 and the suction pump 41, and outputs these signals. The storage unit stores, for example, a film formation time set in advance, a hydrogen overvoltage (described later), a suction time set in advance, and the like.

More specifically, the control device 60 transmits a control signal for controlling starting and stopping of the suction pump 41 to the suction pump 41. Once the suction pump 41 is started, the suction pump 41 continues operating and stops suction in response to a stop signal received from the control device 60. Furthermore, the control device 60 may also control the power supply 13 to start current application or stop current application.

In this modification, during formation of a metal film F, the control device 60 starts the suction pump 41 when a voltage measured by the voltmeter 50 is equal to or higher than a predetermined voltage value, and stops the suction pump 41 after a lapse of a time set in advance after the suction pump 41 is started.

Here, as the electrolytic solution S accumulating between the solid electrolyte membrane 12 and the substrate W increases, the voltage across the anode 11 and the substrate W also increases. When the amount of accumulating electrolytic solution S reaches a predetermined amount, the formed metal film starts to be discolored, and thus the "predetermined voltage" that serves as a reference for starting the suction pump 41 may be equal to or lower than the voltage at this time. Furthermore, the "time set" corresponding to a suction time by the suction pump 41 may be set to a time in which the electrolytic solution S accumulating between the solid electrolyte membrane 12 and the substrate W can be sucked out. This time set can be obtained through experiments or the like, for example.

Control by the control device 60 will be described in detail with reference to the control flow shown in FIG. 6 together with operations and effects.

Figure 6:
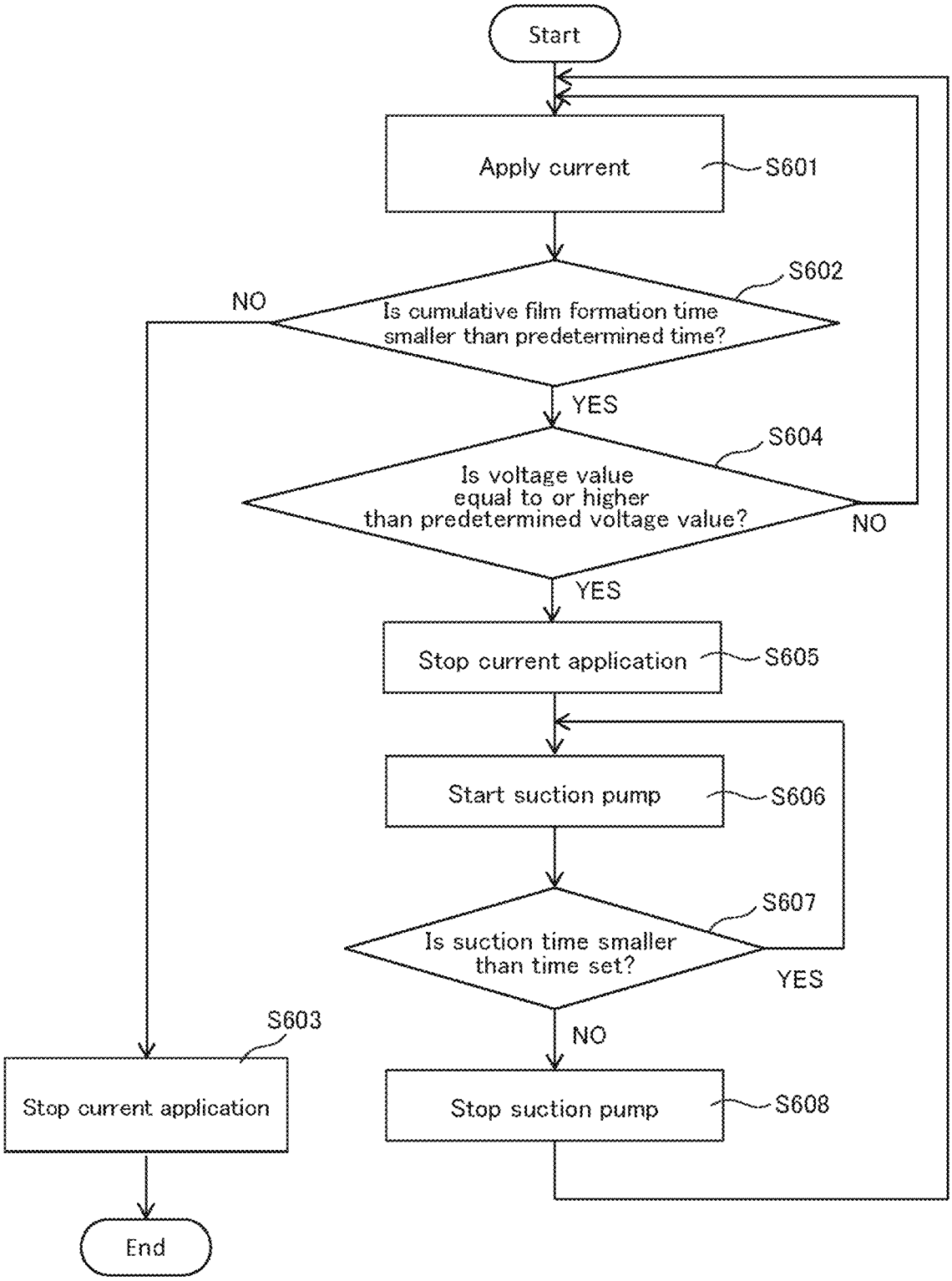
FIG. 6 is a control flowchart of a control device shown in FIG. 5.

FIG. 6 is a control flowchart of the control device 60. The control flow shown in FIG. 6 is performed in the metal film forming step S3 shown in FIG. 3, and thus the following describes the metal film forming step S3 out of step S1 to step S3 of the metal film forming method shown in FIG. 3 It should be noted that the following describes the method controlled by the control device 60, but the method may be performed manually.

First, in step S601, the control device 60 outputs a control signal to the power supply 13 to apply a current between the anode 11 and the substrate W such that a current applied between the solid electrolyte membrane 12 and the substrate W is kept constant. This starts formation of a metal film F in a state where the solid electrolyte membrane 12 is pressed against the substrate W with a fluid pressure.

Next, in step S602, the control device 60 determines whether a cumulative film formation time is smaller than a predetermined time set in advance. If the control device 60 determines that the cumulative film formation time is equal to or larger than the predetermined time (step S602: NO), control proceeds to step S603, where current application is stopped, as will be described later. Then, the film formation ends. In contrast, if the control device 60 determines that the cumulative film formation time is smaller than the time set in advance (step S602: YES), this means that the film formation is in progress, so control proceeds to step S604, where determination of a voltage value is performed.

In step S604, the control device 60 determines whether the measured voltage value between the anode 11 and the substrate W is equal to or higher than a predetermined voltage value. The control device 60 receives a measured voltage value from the voltmeter 50 and performs determination. For example, the control device 60 may determine whether an increase (change) in the measured voltage value relative to a voltage value (initial voltage) at the time when film formation is started is equal to or larger than a predetermined value.

Here, in this modification, in one example, the predetermined value (voltage value) is a hydrogen overvoltage of metal that is a material of the metal film F. The control device 60 may store in advance a hydrogen overvoltage of metal (for example, Cu: 0.58 V, Ni: 0.75 V, Zn: 0.75 V, Ag: 0.76 V, Sn: 1.08 V, and Au: 0.37 V) and appropriately load it in determination.

If the control device 60 determines that the measured voltage value is smaller than the predetermined value (step S604: NO), control returns to step S601. In this case, since there is not a large amount of the electrolytic solution S having passed through the solid electrolyte membrane 12 remaining between the solid electrolyte membrane 12 and the substrate W, formation of a film is continued.

In contrast, if the control device 60 determines that the measured voltage value is equal to or higher than the predetermined value (step S604: YES), control proceeds to step S605. In step S605, since the electrolytic solution S having passed through the solid electrolyte membrane 12 is remaining between the solid electrolyte membrane 12 and the substrate W, the control device 60 controls the power supply 13 to stop current application. This stops formation of the metal film F Here, with reference to a hydrogen overvoltage of metal, at a timing when the measured voltage value reaches the hydrogen overvoltage or higher from the initial voltage, application of a current between the anode 11 and the substrate W is stopped, whereby abnormal deposition of metal can be avoided before it happens.

Next, in step S606, the control device 60 starts the suction pump 41, and control proceeds to step S607. Here, since current application has already been stopped in step S605, vibration of the solid electrolyte membrane 12, if any, during suction by the suction pump 41 will not cause failure in film formation because formation of a metal film F has been suspended.

However, when vibration of the solid electrolyte membrane 12 will not be generated by the suction or when the vibration, if generated, will not affect formation of a metal film F, the formation of a metal film F may be continued without stopping current application in step S605. In this manner, in step S606, discharge of the electrolytic solution S having passed through the solid electrolyte membrane 12 is started.

Next, in step S607, the control device 60 determines whether a suction time is smaller than a time set in advance. This time set is not particularly limited as long as the electrolytic solution S having passed through the solid electrolyte membrane 12 can be mostly discharged within this time.

If the control device 60 determines that a suction time is smaller than a time set in advance (step S607: YES), control returns to the step S606. In this case, suction is continued because the liquid discharge has not been performed sufficiently. In contrast, if the control device 60 determines that a suction time is equal to or larger than a time set in advance (step S607: NO), this can be judged that the electrolytic solution S has been discharged sufficiently, so control proceeds to step S608.

In step S608, the control device 60 stops the suction pump 41 and completes the liquid discharge by the suction pump 41 via the liquid discharge portion 30. After the suction pump 41 is stopped, control returns to step S601 and film formation is started again. In step S602, if the control device 60 determines that a cumulative film formation time, that is, a cumulative time of current application, is not smaller than a predetermined time, this means that a metal film has been formed into a desired thickness while a constant current is being applied, so in step S603, the control device 60 controls the power supply 13 to stop current application, and film formation ends. The above-described control can prepare a substrate W on which a metal film F is formed into a desired thickness. It should be noted that if starting and stopping of the suction pump are repeated preterminal times or more, it may be judged that abnormality has occurred in the film forming apparatus 1. Then, film formation may be stopped.

EXAMPLES

Hereinafter, examples of the present disclosure will be described.

Example

As a substrate on which a film is to be formed on its surface, a glass epoxy substrate having a Cu film formed on its surface (10 cm×10 cm×500 nm as a thickness of a Cu film) was prepared. Next, by using the film forming apparatus shown in FIG. 5, a copper film was formed according to the film forming method shown in FIG. 3, and in the film forming step of forming a copper film, the control device was controlled according to the control flow shown in FIG. 6.

A copper sulfate aqueous solution (1M $CuSO_4$+0.2M $H_2SO_4$) was used for an electrolytic solution. A Cu plate was used for an anode. Nafion N212 (available from DuPont) having a thickness of 8 μm was used for a solid electrolyte membrane. A copper film having a thickness of 1000 μm was formed under the test conditions including: a temperature of 70° C., a current density of 18 A/dm$^2$, a fluid pressure of 0.6 MPa, and a film formation time of 1506 seconds.

During film formation, a voltage across the anode and the substrate was measured, and in the determination of whether the measured voltage value was equal to or higher than a predetermined voltage value (step S604), it was determined whether an increase in the measured voltage value from the voltage value at the time when film formation was started was equal to or larger than a hydrogen overvoltage (0.6 V) of Cu. At a timing when an increase in the measured voltage value reached this voltage value (0.6 V) or larger, suction by the suction pump was performed for one minute. After completion of formation of a film, the appearance of the substrate was observed.

Comparative Example

In the same manner as Example, a copper film was formed and the appearance of the substrate after completion of formation of a film was observed. Comparative Example was different from Example in that a liquid discharge portion was not provided, and discharge of the electrolytic solution S accumulating between the solid electrolyte membrane and the substrate was not performed.

Results and Considerations

Figure 7A:
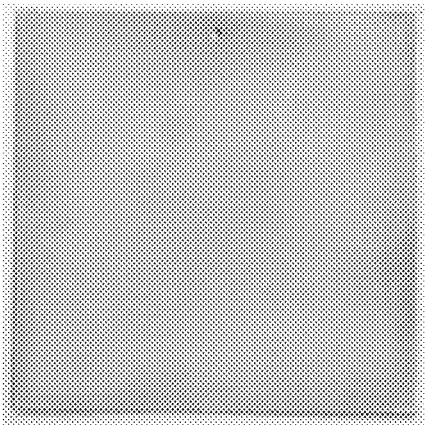
FIG. 7A is a photograph of a test piece of Example, showing its appearance as observed after formation of a film.
Figure 7B:
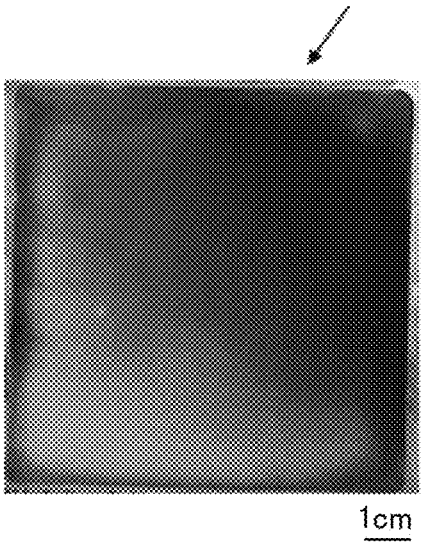
FIG. 7B is a photograph of a test piece of Comparative Example, showing its appearance as observed after formation of a film.

FIG. 7A and FIG. 7B are photographs of a test piece of Example and a test piece of Comparative Example, respectively, showing the appearance as observed after film formation. As can be seen from FIG. 7A, a homogenous copper film was formed in Example. Therefore, by discharging the electrolytic solution having passed through the solid electrolyte membrane through suction by the suction pump via the liquid discharge portion as in Example, it is possible to prevent the electrolytic solution having passed through the solid electrolyte membrane from remaining between the solid electrolyte membrane and the substrate and form a homogenous metal film.

Meanwhile, as can be seen from FIG. 7B, discoloring (a so-called burnt deposit) due to abnormal deposition of metal was found in Comparative Example. It was considered that in Comparative Example, the electrolytic solution having passed through the solid electrolyte membrane was remaining between the solid electrolyte membrane and the substrate, and thus the solid electrolyte membrane deformed so as to be separated from the substrate, which caused a burnt deposit.

Figure 8:
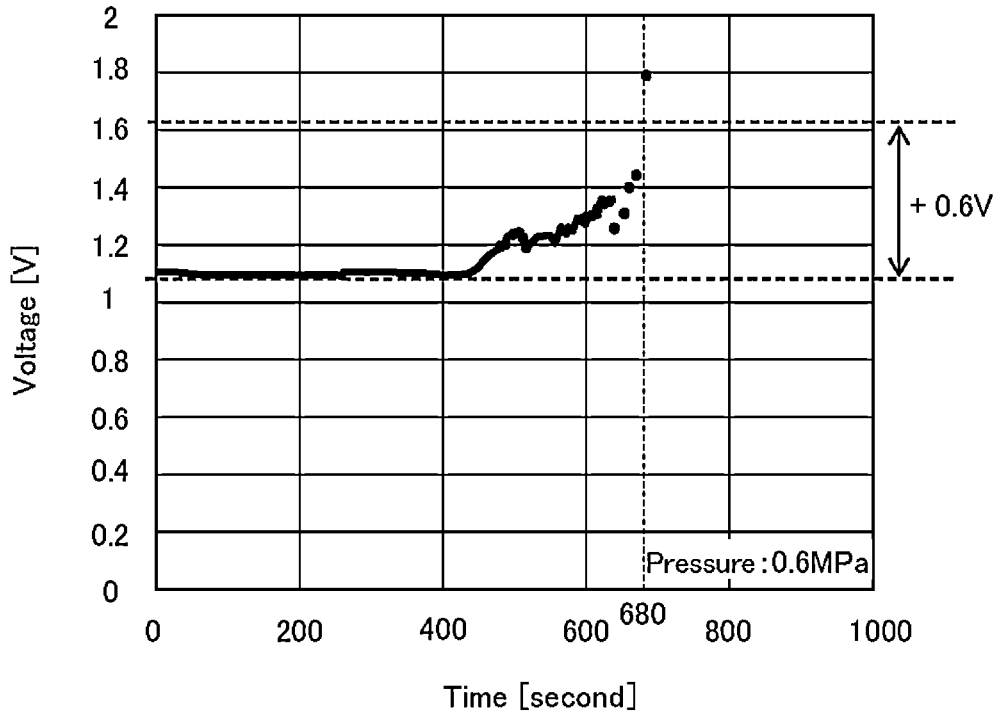
FIG. 8 is a graph showing a voltage change as a film formation time passes according to Example.

FIG. 8 is a graph showing a voltage change as a film formation time passes in Example. As shown in FIG. 8, after start of film formation, a voltage gradually increased as time passed, and around a film formation time of 680 seconds, an increase in voltage from the initial voltage reached 0.6 V, which is a hydrogen overvoltage of Cu, or higher, and thus suction was started. Under such conditions, a homogenous copper film was formed in Example. In view of the above, it is considered that by setting a suction start timing to a timing when an increase in voltage after start of film formation reaches a hydrogen overvoltage (i.e., equal to or larger than a hydrogen overvoltage), it is possible to form a homogenous metal film.

Although one embodiment of the present disclosure has been described in detail above, the present disclosure is not limited to the above embodiment, and various design changes can be made within the spirit and scope of the present disclosure recited in the claims.

What is claimed is:

1. A film forming apparatus for forming a metal film, comprising:

an anode;

a solid electrolyte membrane disposed between the anode and a substrate that serves as a cathode;

a power supply configured to apply a current between the anode and the substrate;

a mount base on which the substrate is placed; and a housing including a storing chamber that stores an electrolytic solution together with the anode and having the solid electrolyte membrane attached thereto so as to seal the storing chamber;

wherein the current is applied in a state where the solid electrolyte membrane is pressed against the substrate with a fluid pressure of the electrolytic solution in the storing chamber to form a metal film from metal ions contained in the electrolytic solution on a surface of the substrate; and the mount base includes a liquid discharge port configured to discharge the electrolytic solution having passed through the solid electrolyte membrane from a position facing an end face of a side wall of the housing;

wherein the mount base includes a housing recess that is formed in accordance with a shape of the substrate as a recess for placement, the liquid discharge port includes a liquid discharge groove, and the liquid discharge groove is formed to surround the housing recess with a distance from an edge of the housing recess.

2. A film forming apparatus for forming a metal film, comprising:

an anode;

a solid electrolyte membrane disposed between the anode and a substrate that serves as a cathode;

a power supply configured to apply a current between the anode and the substrate;

a mount base on which the substrate is placed; and a housing including a storing chamber that stores an electrolytic solution together with the anode and having the solid electrolyte membrane attached thereto so as to seal the storing chamber;

wherein the current is applied in a state where the solid electrolyte membrane is pressed against the substrate with a fluid pressure of the electrolytic solution in the storing chamber to form a metal film from metal ions contained in the electrolytic solution on a surface of the substrate, and the mount base includes a liquid discharge portion port configured to discharge the electrolytic solution having passed through the solid electrolyte membrane from a position facing an end face of a side wall of the housing;

wherein a suction pump that sucks the electrolytic solution from the liquid discharge port is coupled to the liquid discharge port; and wherein the power supply is configured to apply a current between the anode and the substrate such that a current applied between the anode and the substrate is kept constant during formation of the metal film, the film forming apparatus for forming a metal film further comprising:

a voltmeter configured to measure a voltage across the anode and the substrate; and a control device configured to control starting and stopping of the suction pump;

wherein during the formation of the metal film, the control device starts the suction pump when a voltage measured by the voltmeter is equal to or higher than a predetermined voltage value, and stops the suction pump after a lapse of a time set in advance after the suction pump is started.

* * * * *